US005230454A

United States Patent [19]

Nonaka et al.

[11] Patent Number: 5,230,454

[45] Date of Patent: Jul. 27, 1993

[54] AUTOMATIC DOCUMENT FEEDER CAPABLE OF HANDLING COMPUTER FORM DOCUMENT

[75] Inventors: Mitsuhiro Nonaka, Yokohama; Toshihiro Ishibashi, Chiba, both of Japan

[73] Assignee: Ricoh Company, Ltd., Tokyo, Japan

[21] Appl. No.: 686,969

[22] Filed: Apr. 18, 1991

[30] Foreign Application Priority Data

Apr. 18, 1990 [JP] Japan ..... 2-102549

[51] Int. Cl.[5] ..... B65M 45/101

[52] U.S. Cl. ..... 226/24; 226/29; 226/42; 226/178; 493/410; 270/39

[58] Field of Search ..... 226/1, 2, 24, 29, 42, 226/178, 43, 74; 493/320, 410, 412; 270/39

[56] References Cited

U.S. PATENT DOCUMENTS 3,807,724 4/1974 Bartz ..... 226/171 X R
3,820,700 6/1974 Quirijnen ..... 226/171 X R
3,997,093 12/1976 Aizawa et al. ..... 226/74 X T
4,264,200 4/1981 Tickner et al. ..... 226/74 X R
4,300,710 11/1981 Du Bois et al. ..... 226/74
4,485,949 12/1984 Gebhart et al. ..... 226/2
4,834,277 5/1989 Gromoll et al. ..... 226/74 X R
4,928,940 5/1990 Dash ..... 270/21.1 X R
5,062,597 11/1991 Martin et al. ..... 270/39

*Primary Examiner*—Daniel P. Stodola
*Assistant Examiner*—Paul T. Bowen
*Attorney, Agent, or Firm*—Mason, Fenwick & Lawrence

[57] ABSTRACT

An automatic document feeder (ADF) for use with with a copier, laser printer or similar image recorder and capable of handling a computer form (CF) document in addition to ordinary documents in the form of sheets. The ADF is selectively operable in either one of two different document transport modes, i.e., it transports initial fives pages of a CF document at a speed per page which is lower than an ordinary speed. While the lower transport speed is selected, the operator has a sufficient time to determine in which direction the CF document neatly folds along the perforation intervening between the first and second pages.

2 Claims, 13 Drawing Sheets

AUTOMATIC DOCUMENT FEEDER CAPABLE OF HANDLING COMPUTER FORM DOCUMENT

BACKGROUND OF THE INVENTION

The present invention relates to an automatic document feeder (ADF) which may be mounted on the top of a copier, laser printer or similar image recorder for transporting ordinary sheet documents or a computer form (CF) document, as desired. More particularly, the present invention is concerned with an ADF capable of controlling the transport of a CF document.

An ADF is extensively used today with an image recorder for automatically transporting a document to be recorded to a recording position of the recorder, thereby remarkably increasing the recording speed available with the image recorder. An advanced ADF is capable of handling a so-called CF document or paper in addition to ordinary documents in the form of sheets. The CF document has a plurality of consecutive pages thereon which adjoin each other with the intermediary of a perforation and are stored in a folded position. This type of ADF transports such a CF document to a predetermined recording position, sets it there, and then drives it out from the ADF via an outlet. When mounted on the top of the image recorder, this ADF allows the successive pages of the CF document to be recorded one after another.

Before the ADF capable of handling a CF document is operated to record successive images printed on a CF paper continuously, a collecting box, for example, is placed beneath the outlet of the ADF for receiving the CF document. On the turn-on of a predetermined key, a continuous copying operation is started. As soon as the first page of the CF document is driven out via the outlet to reach the collecting box, the operator determines the direction in which the document should be folded along the perforation intervening between the first and second pages of the document. Specifically, the CF document is set on the bottom of the box with the first page thereof folded in an expected or easy-to-fold direction. As a result, the second and successive pages of the CF paper sequentially arriving at the box are automatically neatly turned down in the box one after another.

However, when the determined direction for folding the CF between the first and second pages is not correct, the first page is not accurately set on the bottom of the box and the first page is often folded in the other direction or folded only loosely. Then, the second and successive pages each is folded in the wrong direction and not neatly folded with the result that they pile up to more than an expected height. In the worst case, such CF paper will overflow the box. While the CF paper so folded in wrong directions may be refolded in right directions afterwards, refolding it after many pages have overflown the box is time-consuming since the CF paper has a substantial length.

In parallel with the trend toward a higher recording speed, e.g., higher copying speed, the speed at which a scanner is moved in a reciprocating motion relative to a platen is decreasing. When a CF document is used, the scanning speed cannot be increased unless the time per page during which the document stays on the platen is reduced. Therefore, the transpot speed per page (reciprocal of the interval between the start of transport of one page of document and the discharge of the same to the outside) is high. It follows that the operator has to determine the direction in which the CF document being discharged is easier to fold along the perforation intervening between the first and second pages within an extremely short period of time. Specifically, the operator usually folds the CF document in opposite directions along the perforation to see the direction in which the document folds more easily or neatly, and again folds it in such a direction. This, however, has a problem that when the operator determines the direction in which the CF paper is easier to fold after folding it twice, the operator has to fold it again in the easier direction, i.e., three times of folding is necessary in total. When the operator has determined the folding direction, several pages of the CF paper have already been driven out. Then, the operator sequentially correctes the folds of the second and successive pages in direction. However, manually refolding the second and successive pages one by one cannot keep up with the rapid discharge of the CF document.

SUMMARY OF THE INVENTION

It is therefore an object of the present invention to provide an ADF capable of transporting a computer form document such that the document can be neatly folded in a collecting box.

It is another object of the present invention to provide a generally improved ADF.

An ADF for use with an image recorder for recording not only ordinary documents in the form of sheets but also a continuous CF document carrying a plurality of pages thereon which are folded along perforations of the present invention comprises a document transporting mechanism for transporting any one of the documents to a predetermined recording position of the image recorder, setting the document at the predetermined recording position, and, after a recording operation, transporting and discharging the document into collecting box, and a control system for controlling the document transporting mechanism such that any one of a plurality of transport modes each transporting the ordinary documents and the CF document at, respectively, a particular speed per sheet and a particular speed per page is selected.

BRIEF DESCRIPTION OF THE DRAWINGS

The above and other ojects, features and advantages of the present invention will become more apparent from the following detailed description taken with the accompanying drawings in which.

DESCRIPTION OF THE PREFERRED EMBODIMENT

To better understand the present invention, problems particular to a conventional ADF capable of handling a computer form (CF) document will be described with reference to FIGS. 1 through 4.

Figure 1:
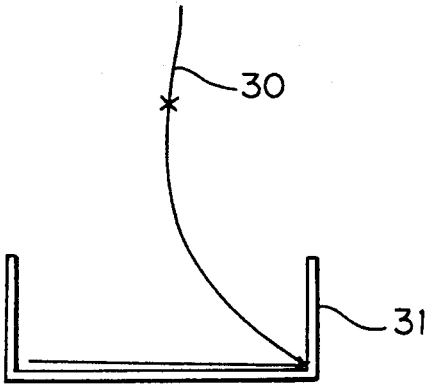
FIG. 1 is a view showing a CF document which is neatly folded along the perforation between the first and second pages and set on the bottom of a collecting box after being discharged from an ADF.
Figure 2:
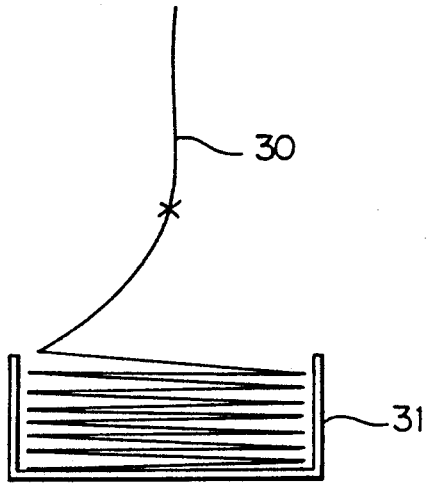
FIG. 2 shows the successive pages of the CF document sequentially folded in the collecting box.

The conventional ADF is of the type transporting a a CF document or paper by each predetermined amount, sequentially sets each page of the CF paper at a predetermined position of the platen of a copier or similar image recorder, and drives it out of the ADF. A collecting box, for example, is placed beneath the outlet of the ADF for receiving the CF paper coming out through the outlet. After the copier has started on a continuous copy mode operation in response to the operation of a predetermined key, the first page of the CF paper is driven out from the outlet into the collecting box. Then, the operator determines the direction in which the CF paper is expected to fold, i.e., easier to fold along the perforation intervening between the first and second pages thereof. Specifically, as shown in FIG. 1, the CF paper 30 is set on the bottom of the box 31 with the first page thereof turned down toward the front or the rear. In the figures, the perforations of the CF paper 30 are indicated by crosses. As result, the second and successive pages of the CF paper 30 sequentially arriving at the box 31 are automatically neatly folded one after another, as shown in FIG. 2.

Figure 3:
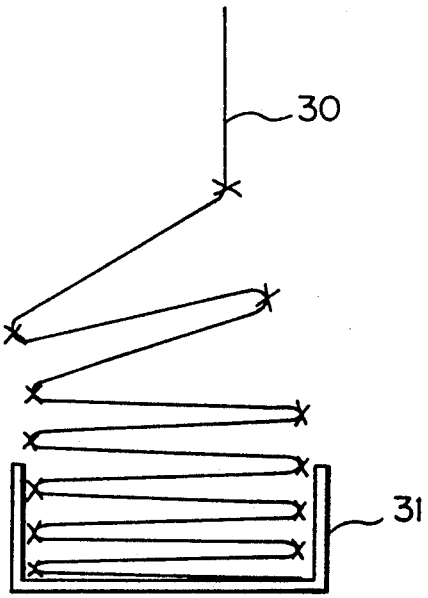
FIGS. 3 and 4 each shows a particular condition in which the CF document would be set on the bottom of the collecting box when folded in the wrong direction along the perforation between the first and second pages.
Figure 4:
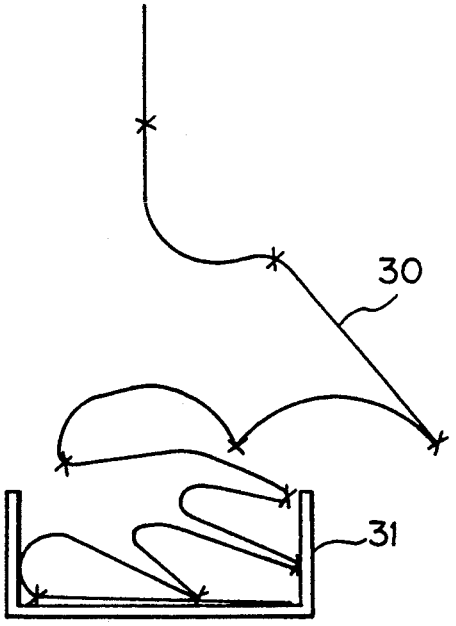

However, when the perforation between the first and second pages of the CF paper 30 is not correctly determined as to the folding direction, the first page is often folded in the wrong direction or folded only loosely. Then, as shown in FIG. 3, the second and successive pages each is turned down in the wrong direction and not neatly folded with the result that they pile up to more than an expected height. In the worst case, such CF paper 30 will overflow the box 31, as shown in FIG. 4. While the CF paper 30 so folded in wrong directions may be refolded in right directions afterwards, refolding it after many pages have overflown the box 31 is tim-consuming since the CF paper 30 has a substantial length.

In light of this, it is a common practice for the operator to fold the CF paper 30 in opposite directions along the perforation to determine the direction in which it is easier to fold, and then fold it in such a direction. The problem with this scheme is that when the operator finds the direction in which the CF paper 30 folds more easily after folding it twice, the operator has to fold it again in that direction, i.e., three times of folding is required in total. At the time when the operator has determined the folding direction, several pages of the CF paper 30 have already been driven out of the ADF. Then, the operator sequentially corrects the folding directions of the second and successive pages. However, correcting the folding directions by hand is too slow to cope with the speed at which the CF paper is driven out of the ADF.

Figure 5:
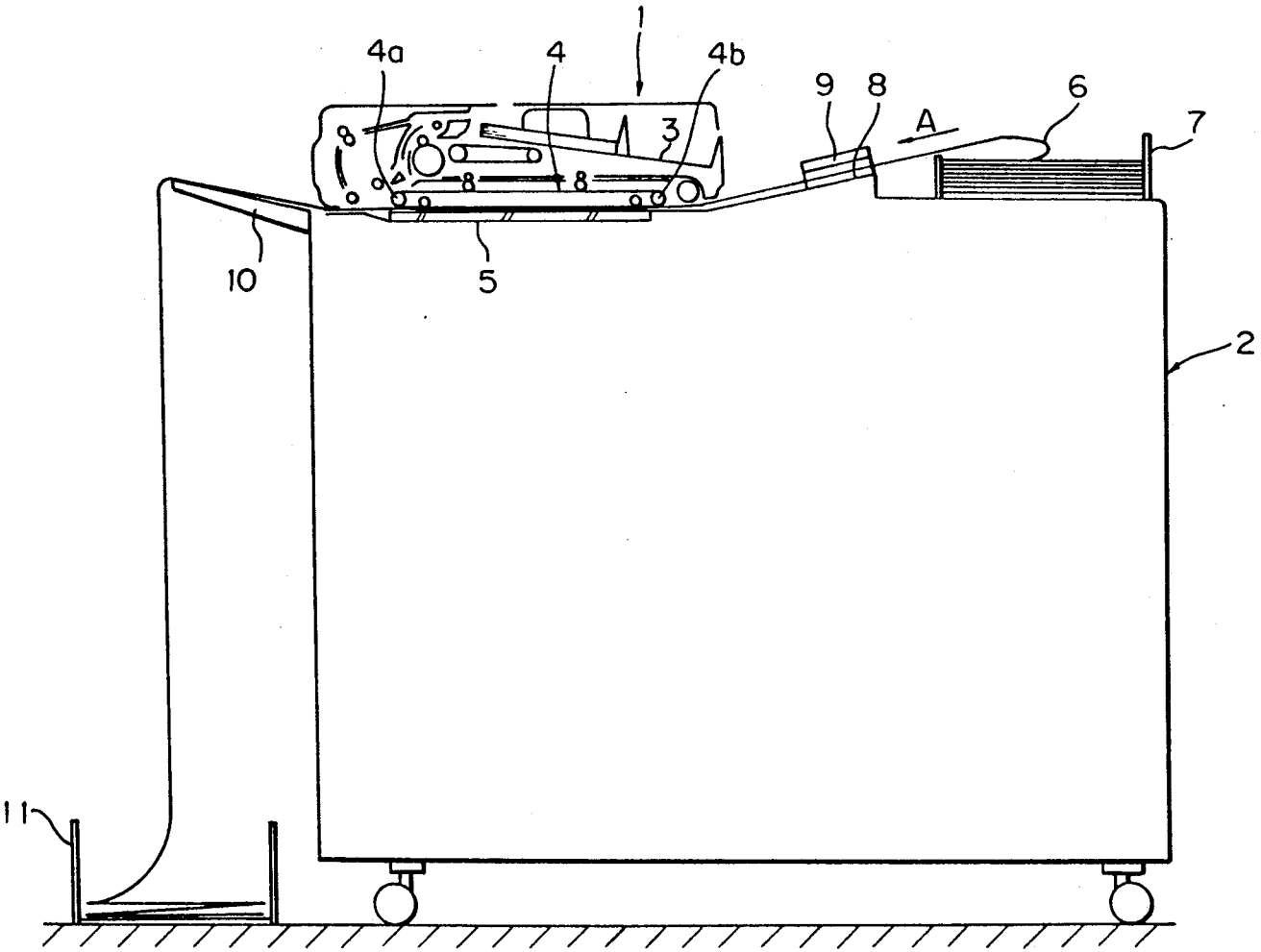
FIG. 5 is a view showing the general construction of a recyclic automatic document feeder embodying the present invention and a copier body on which it is mounted.
Figure 6:
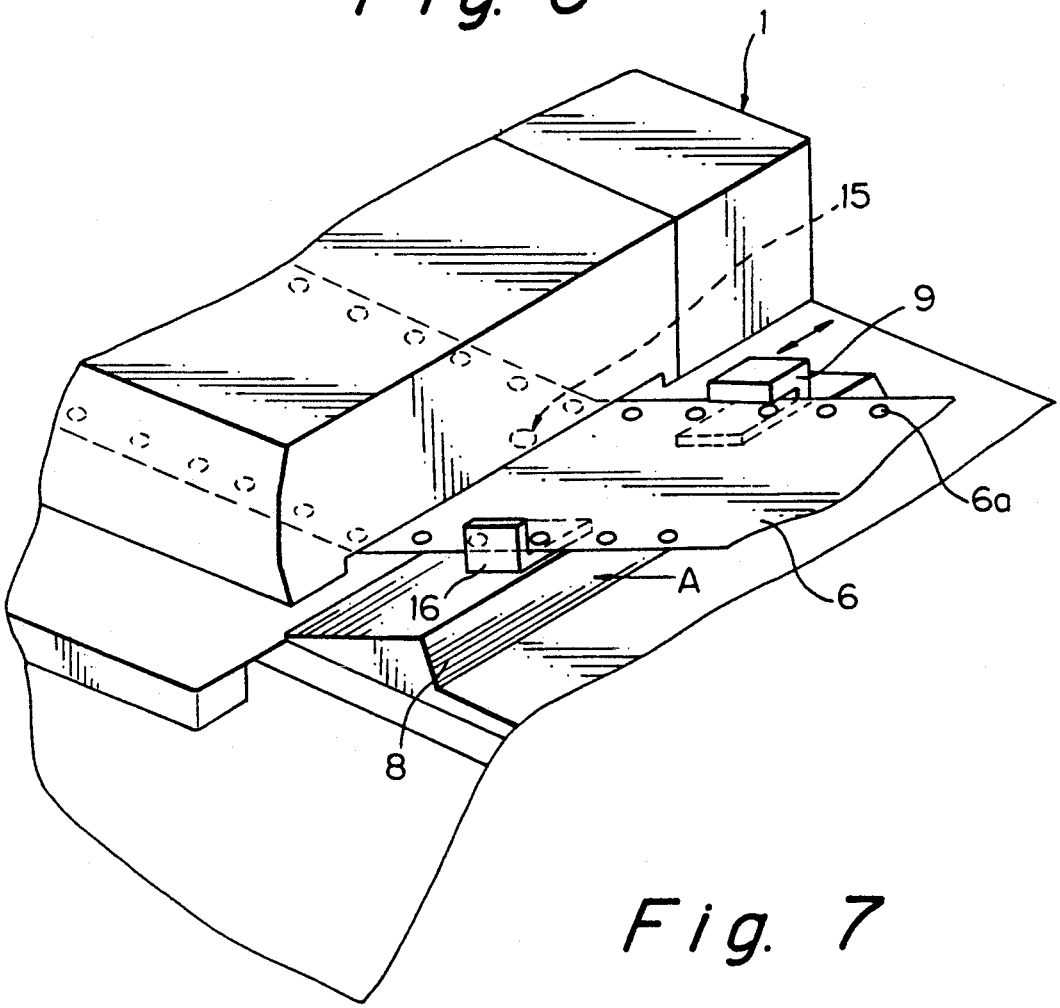
FIG. 6 is a perspective view a CF document table and a CF document being transported on and along the CF document table.

Referring to FIG. 5, a recyclic automatic document feeder (RADF) embodying the present invention and a copier on which it is mounted are shown. The RADF, generally 1, is rotatable or openable away from the copier body 2 and has a tray 3 which may be loaded with a plurality of documents in the form of sheets. A transport belt is located below the tray 3 and passed over a pair of rollers 4*a* and 4*b* for transporting a document. When the RADF 1 is held in a closed position shown in FIG. 5, the belt 4 remains in contact with the upper surface of a platen 5 included in the copier body 2. The copier body 2 has a CF paper tray 7 for accommodating CF paper 6 which is a continuous document folded along perforations each intervening between nearby pages. A CF paper table 8 is disposed between the RADF 1 and the CF paper tray 7. As also shown in FIG. 6, a hole sensor block 9 is mounted on the upper surface of the CF paper table 8 and movable in a reciprocating motion, as indicated by an arrow B in FIG. 6. The copier body 2 further has a discharge tray 10 on the top thereof at the rear of the RADF 1.

Figure 7:
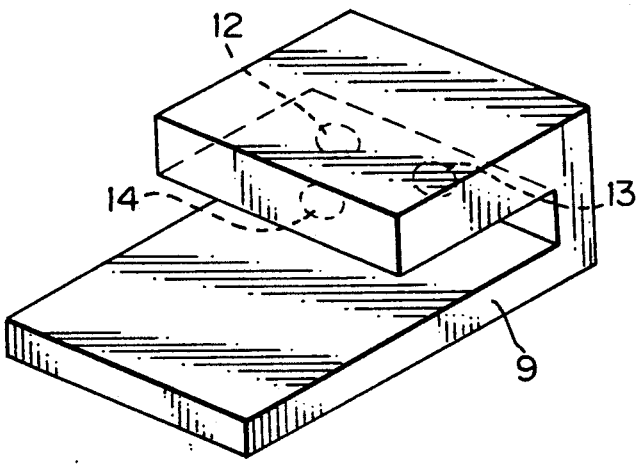
FIG. 7 is a perspective view of a sensor block included in the embodiment.

As shown in FIGS. 6 and 7, the hole sensor block 9 has a generally U-shaped configuration. Two hole sensors 12 and 13 and a single CF set sensor 14 are embedded in the inner periphery of the upper portion of the hole sensor block 9, and each is implemented as a reflection type photosensor. The sensors 12 and 13 are responsive to, among a number of equally spaced holes 6*a* formed through opposite side edges of the CF paper 6, the holes 6*a* located one side edge of the CF paper 6. The sensor 14 determines whether or not the CF paper 6 has been set. As shown in FIG. 6, a CF passage sensor 15 is disposed in the RADF 1 adjacent to a paper inlet so as to sense the passage of the last page of the CF paper 6. A generally L-shaped member 16 is affixed to the CF paper table 8 to face the hole sensor block 9 with the intermediary of the CF paper 6. This member 16 cooperates with the hole sensor block 9 to adjust the position in which the CF paper 6 is set in the widthwise direction.

Before the CF paper or document 6 having a plurality of pages is reproduced in a continuous copy mode, a box 11, FIG. 5, for collecting it is placed beneath the discharge tray 10. Then, the operator opens the RADF 1, sets the first page of the CF paper 6 on the platen 5 of the copier body 2, moves the hole sensor block 9 in the direction B, FIG. 6, to a position just short of one side edge of the CF paper 6, and then presses a print key, not shown. As a result, the copier body 2 scans the first page of the CF paper 6 set on the platen 5 thereof. Subsequently, the transport belt 4 drives the CF paper 6 in a direction A, FIG. 6, until the first page has been driven out of the ARDF 1. At this time, the second page is automatically set on the predetermined position of the platen 5. Thereafter, the scanning operation and the transport of the CF paper 6 are effected alternately.

The discharged part of the CF paper 6 advances along the upper surface of the discharge tray 10. As the CF paper 6 is further discharged, it hangs down from the discharge tray 10 and sequentially folded within the box 11.

As soon as the first and second pages of the CF document 6 have been driven out, the operator determines in which direction the CF paper 6 is easier to fold along the perforation intervening between the two pages. Then, the operator folds the CF paper in the easier direction along the perforation of interest and sets it on the bottom of the box 11. As a result, the consecutive pages sequentially reaching the box 11 are neatly turned down, as shown in FIG. 5. On the other hand, when the operator stacks a plurality of sheet documents on the document tray 3 and then presses the print key, the each of the documents is automatically fed to the predetermined position on the platen 5, scanned by the copier body, and then returned to the document tray 3 or driven out to the discharge tray 10.

Figure 8:
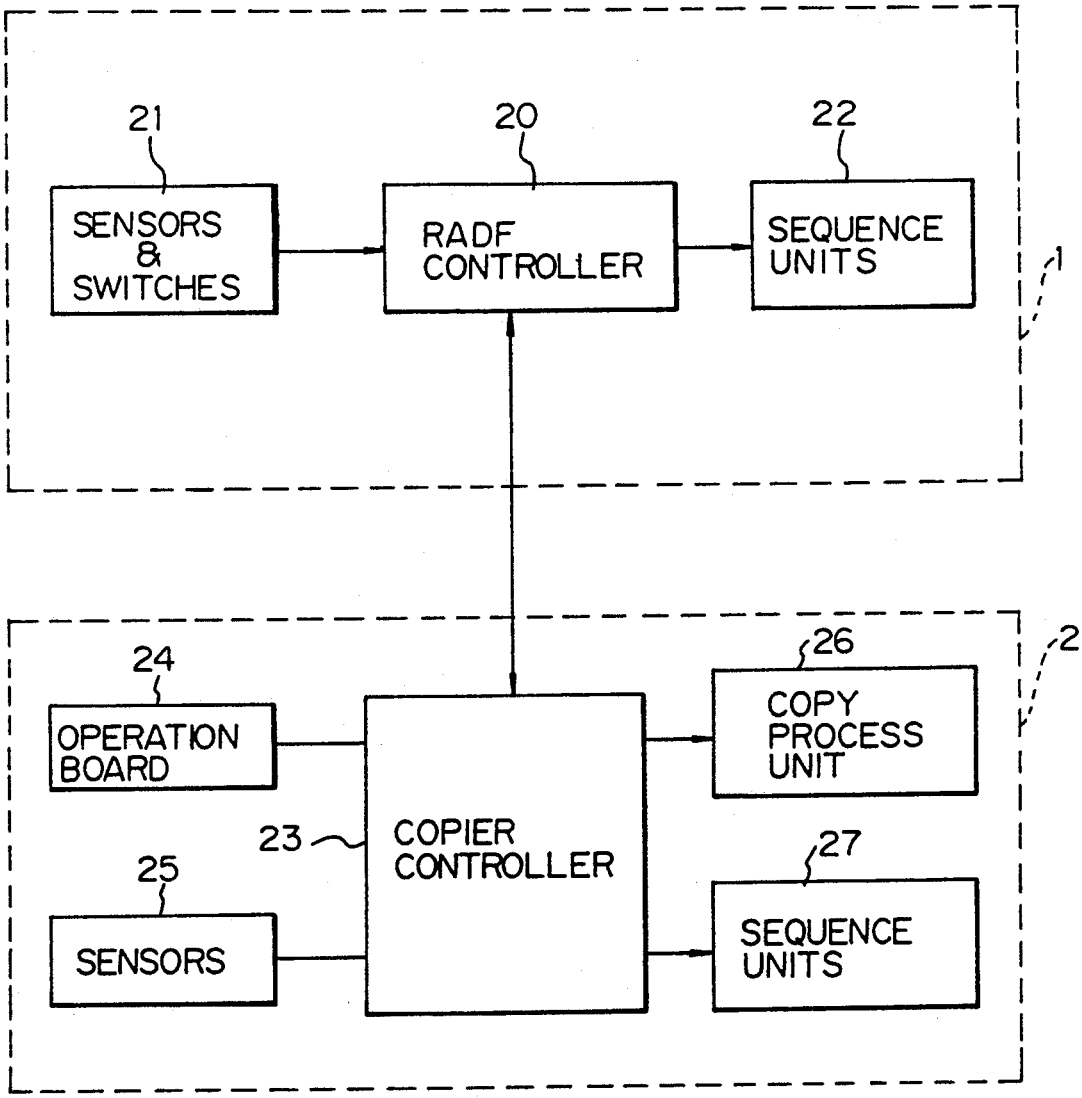
FIG. 8 is a block diagram schematically showing a control system for controlling the document feeder and copier.

Referring to FIG. 8, a control system for controlling the RADF 1 and copier body 2 will be described. As shown, the RADF 1 has a controller 20 having a microcomputer which includes a CPU, ROM, RAM, various counters which will be described, I/O, etc. Sensors and switches 21 include the previously mentioned four sensors 12 through 15 and feed the outputs thereof to the RADF controller 20. A copier controller 23 incorporated in the copier body 2 send various information to the RADF controller 20. In response, the RDH controller 20 controls various sequence units including motors such as a feed motor, transport motor and discharge motor, solenoids, etc. At the same time, the RADF controller 20 sends information to the copier controller 23. The copier controller 23, like the RADF controller 20, has a microcomputer which receives information from an operation board 24 and the RADF controller 20 as well as from sensors 25. The copier controller 23 controls copy process units 26 and sequence units 27 while sending information to the RADF controller 20.

Figure 9:
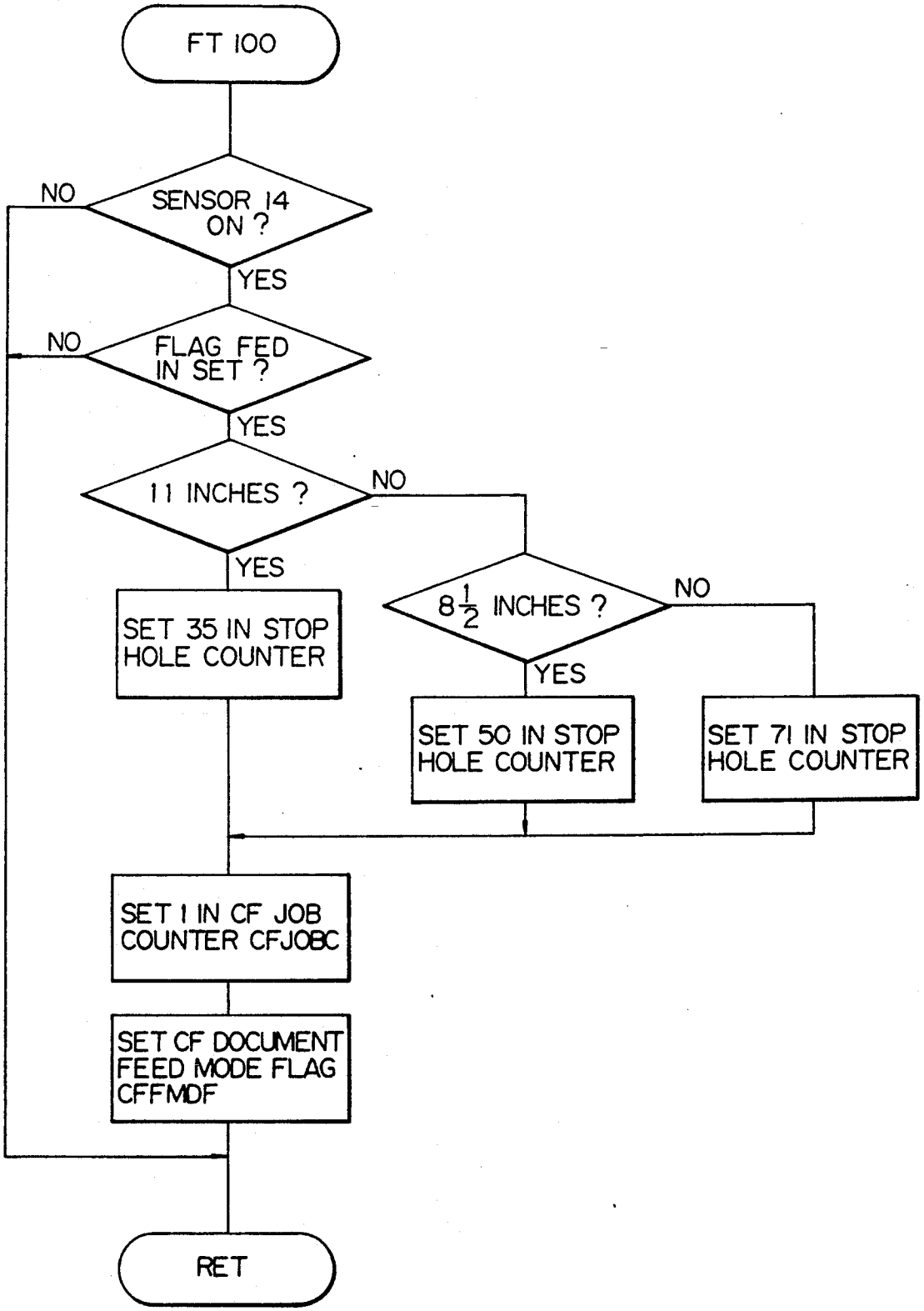
FIG. 9 is a flowchart demonstrating a feed timer subroutine FT100 to be executed by an RADF controller.

A reference will also be made to FIG. 9 for describing specific operations of the embodiment. To better understand the operations, let it be assumed that the copier body 2 is selectively operable at either one of two different copying speeds, i.e., 50 c.p.m (copies per minute) and 20 c.p.m in matching relation to the document feed speed of the RDH1. It is to be noted that the term "document transport speed" refers to the reciprocal of the transport and stop cycle length per page, e.g., the reciprocal of the interval between the time when one page of CF paper 6 starts moving toward the platen 5 away from the CF paper table 8 and the time when it reaches the discharge tray 10.

FIGS. 9 through 16 show various subroutines relating to the control which the RADF controller 20 executes over the transport of the CF paper 6. These subroutines are sequentially called by a main routine, not shown.

Specifically, FIG. 9 shows a feed timer subroutine (FT100). As shown, the RADF controller 20 determines whether or not the CF set sensor 14 is in an ON state and, if it is not in an ON state, immediately returns to the main routine. If the sensor 14 is in an ON state, the controller 20 determines whether or not a flag FEDIN is set. The flag FEDIN will be set by a transport command sent from the copier controller 23. If the flag FEDIN is not set, the controller 20 returns to the main routine. If it is set, the controller 20 determines whether or not the size of the CF document sent from the copier controller 23 is 11 inches. If the result of this decision is positive, the controller (CPU) 20 sets "65" in a stop hole counter CFSTPC and "1" in a CR job counter CFJOBC. After setting a CF document feed mode flag CFFMDF, the program returns to the main routine. If the size of the CF document is not 11 inches, whether or not it is $8\times\frac{1}{2}$ inches is determines. If the result of decision is positive, "50" is set in the stop hole counter CFSTPC; if otherwise, "71" is set in the counter CFSTPC.

Figure 10:
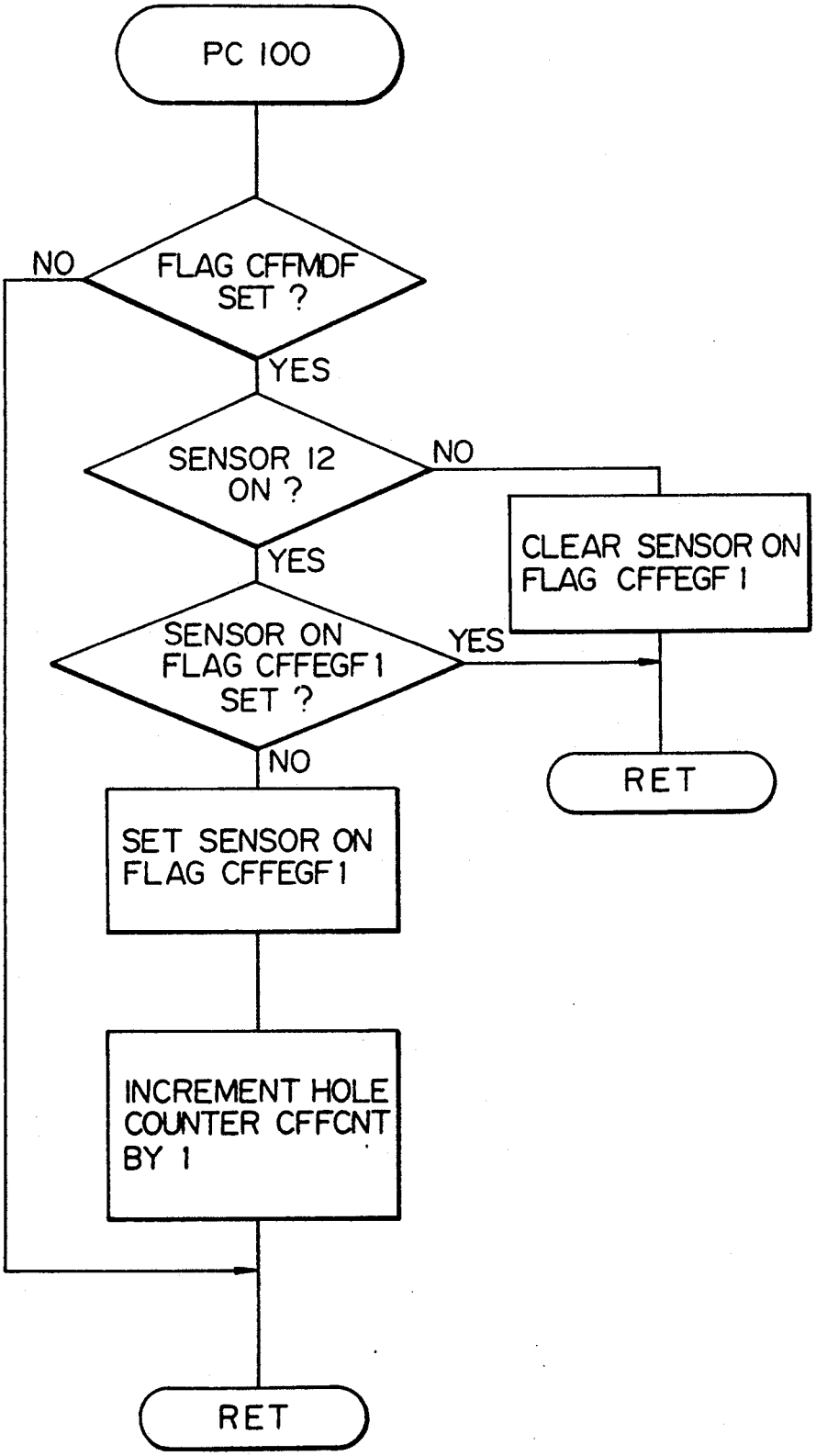
FIG. 10 is a flowchart showing a hole count subroutine PC100 to be executed by the RADF controller.

FIG. 10 shows a subroutine for counting the holes of the CF document (PC 100). As shown, whether or not the CF document feed mode flag CFFMDF is set is determined. If the result of decision is negative, the program returns to the main routine immediately; if otherwise, whether or not the hole sensor 12 is in an ON state is determined. If the sensor 12 is not in an ON state, a sensor ON flag CFFEGF1 is cleared and the program returns to the main routine; if it is in an ON state, whether or not the sensor ON flag CFFEGF1 is set is determined. If the result of this decision is positive, the program returns to the main routine. If the sensor ON flag CFFEGF1 is not set, it is set, a hole counter CFFCNT built in the RADF controller 20 is incremented by 1, and then the program returns.

Figure 11:
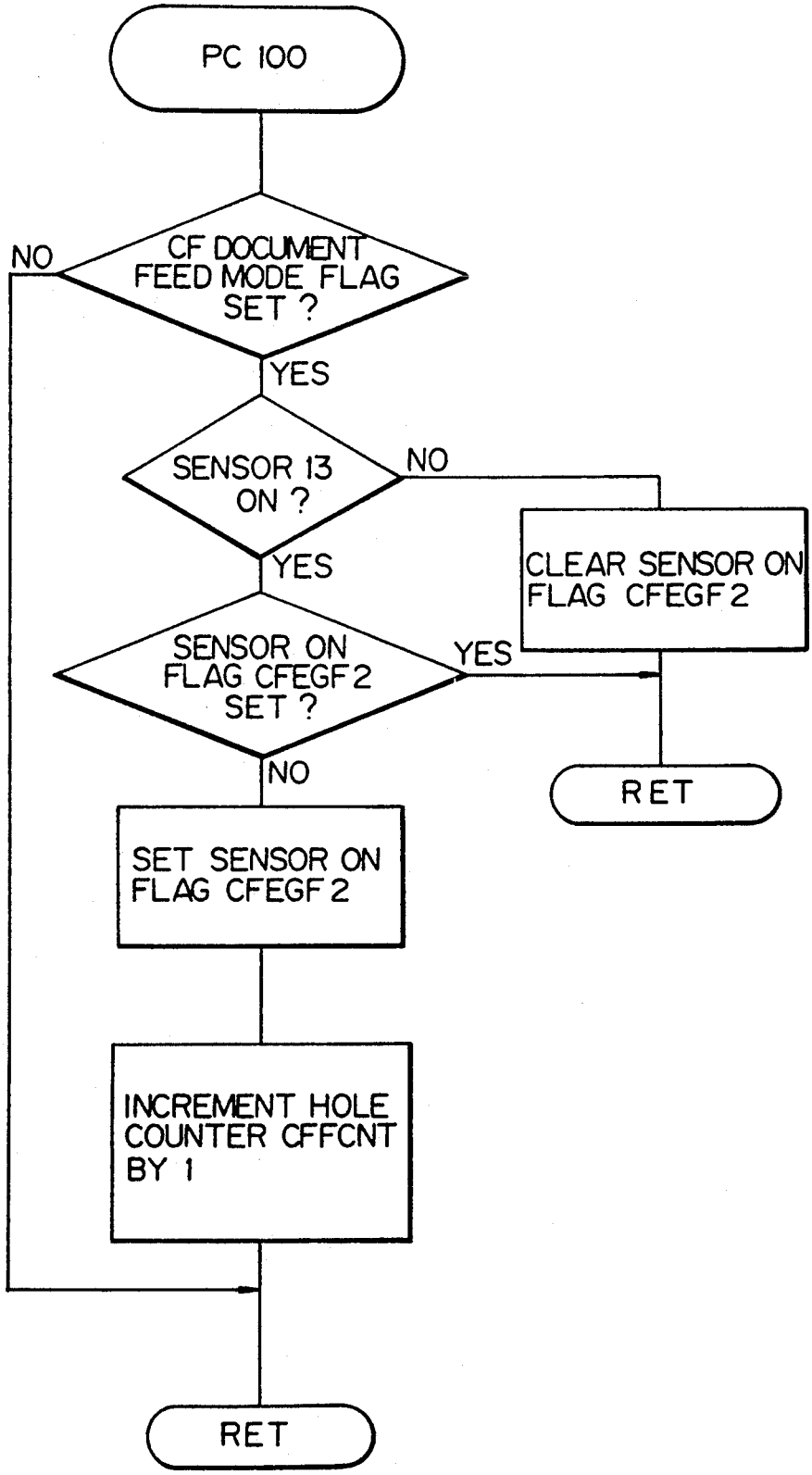
FIG. 11 is a flowchart showing another hole count subroutine PC200 assigned to the RADF controller.

FIG. 11 shows another subroutine for counting the holes of the CF paper (PC 200). As shown, whether or not the CF feed mode flag CFFMDF is set is determined. If this flag is not set, the program returns to the main routine; if it is set, whether or not the sensor 13 is in an ON state is determined. If the sensor 13 is not in an ON state, a sensor ON flag CFFEGF2 is cleared, and then the program returns to the main routine. If the sensor 13 is in an ON state, whether or not the sensor ON flag CFFEGF2 is set is determined. If this flag CFFEGF2 is set, the program also returns to the main routine immediately. If the sensor ON flag CFFEGF2 is not set, it is set, the hole counter CFFCNT is incremented by 1, and then the program returns to the main routine.

Figure 12:
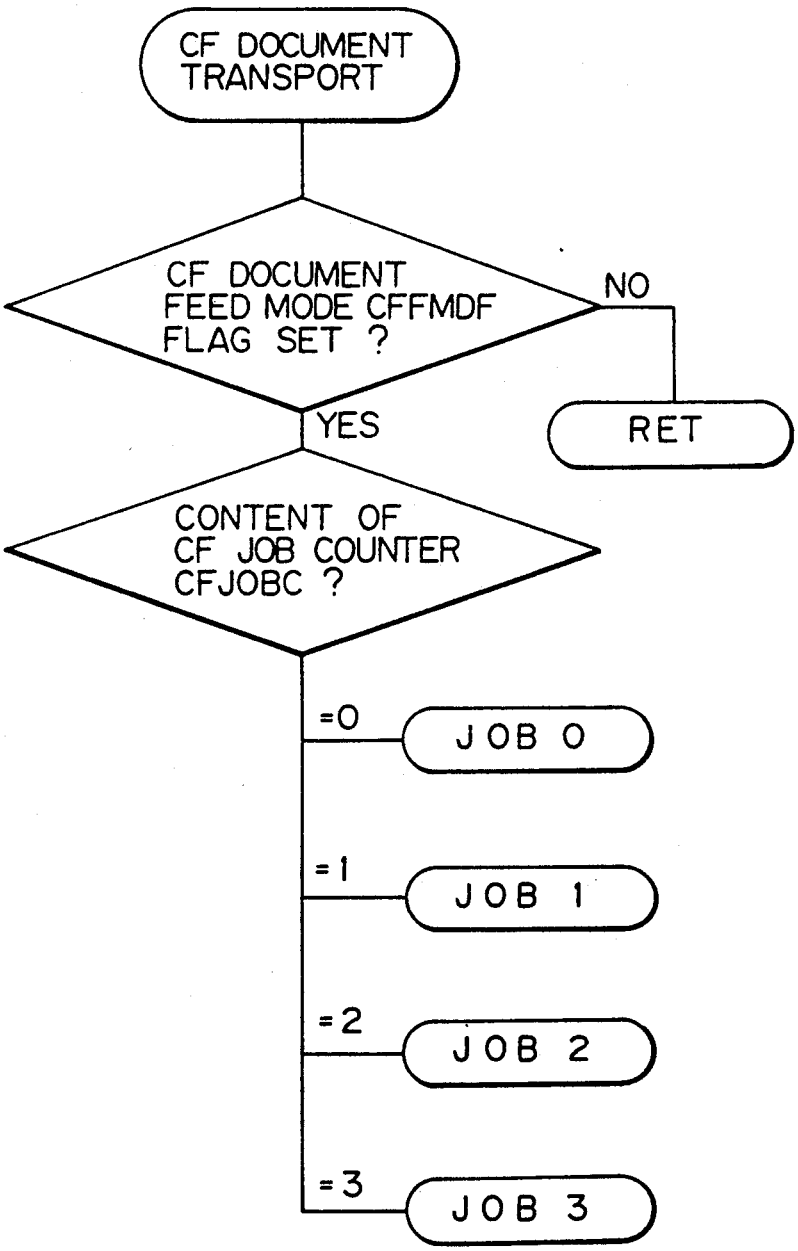
FIG. 12 is a CF document transport subroutine also assigned to the RADF controller.

FIG. 12 shows a CF feed subroutine while FIGS. 13 through 16 show jobs JOB0 through JOB3 included in the CF feed subroutine.

When the copier controller 23 sends a document transport command to the RADF controller 20, the subroutine shown in FIG. 12 is called by the main routine. First, whether or not the document feed mode flag CFFMDF is set is determined. If the flag CFFMDF is not set, the program returns; if it is set, the content of the CF job counter is referenced. Because the CF job counter has been incremented to "1" by the routine shown in FIG. 9, the JOB1 shown in FIG. 4 is executed. The JOB1 turns on a feed motor, transport motor and discharge motor, clears the hole counter CFFCNT, and then increments the CF job counter CFJOBC by 1 to "2". Thereupon, the program returns to the main routine.

Figure 15:
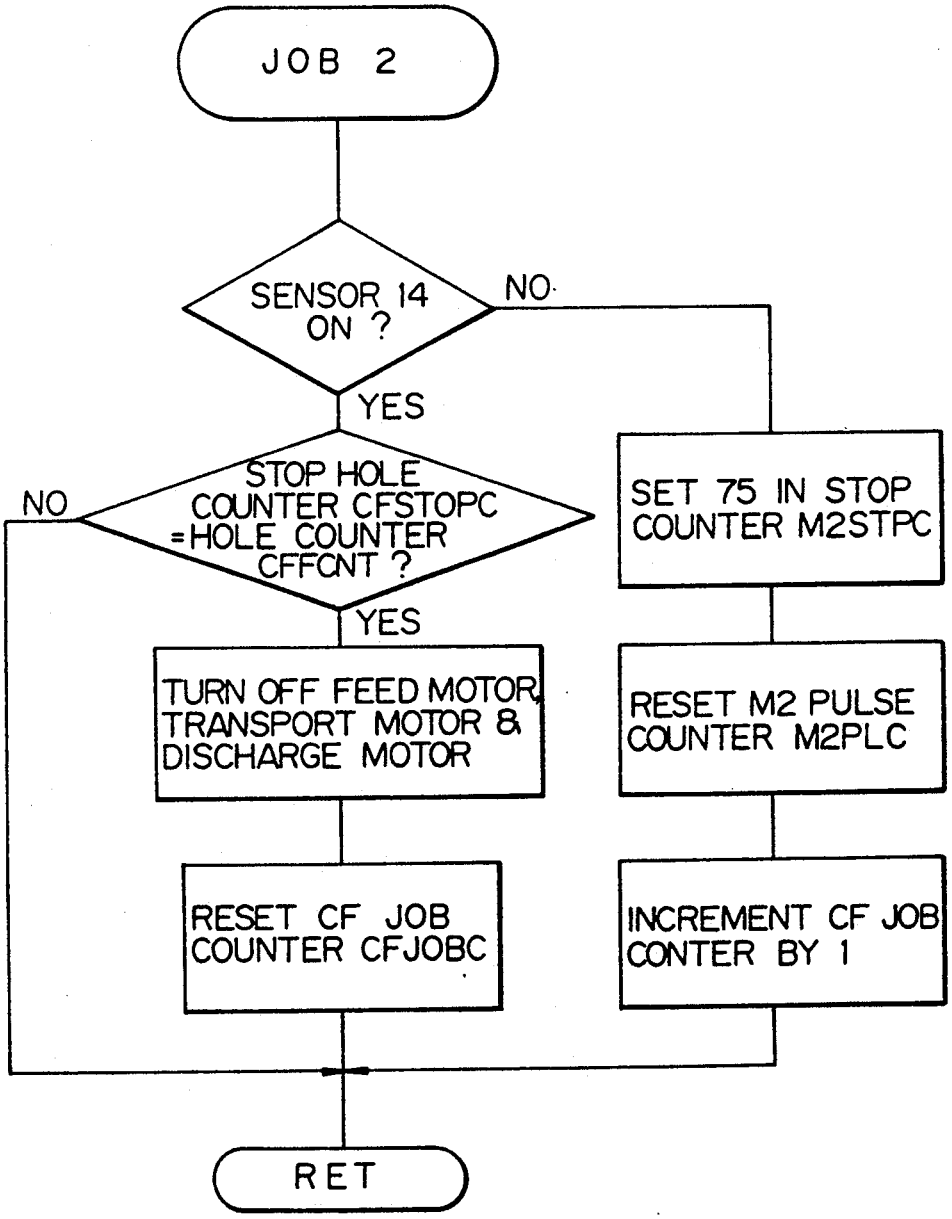

If the CF job counter CFJOBC has been incremented to "2" as determined by the next routine of FIG. 12, the program advances to the JOB2 shown in FIG. 15. In FIG. 15, whether or not the CF set sensor 14 is in an ON state is determined. If it is in an ON state, whether or not the stop hole counter CFSTOPC and the hole counter CFFCNT compare equal is determined. If the result of this decision is negative, the program returns to the main routine; if it is positive, the feed motor, transport motor and discharge motor are turned off, the CF job counter CFJOBC is reset, and then the program returns to the main routine. On the other hand, if the CF set counter 14 is not in an ON state, "75" is set in a stop counter M2STPC which is incorporated in the RADF controller 20 for stopping the transport motor. Thereafter, a pulse counter M2PLC for counting the output pulses of a rotary encoder which is mounted on the output shaft of the transport motor is cleared, the CF job counter CFJOBC is incremented to "3", and then the program returns to the main routine.

Figure 16:
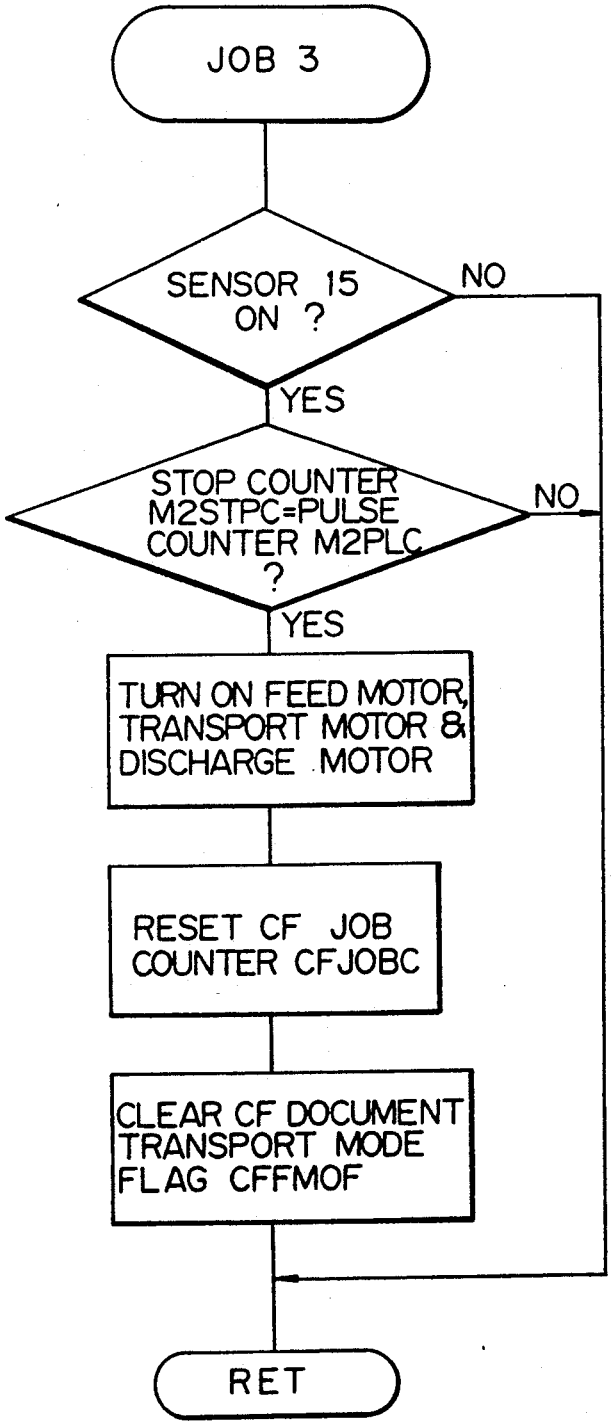

As the CF job counter CFJOBC is determined to be "3" by the subsequent routine 12 of FIG. 12, the JOB3 shown in FIG. 16 is executed. First, whether or not the CF passage sensor 15 is in an OFF state is determined and, if the answer is negative, the program returns. If the sensor 15 is in an OFF state, whether or not the stop counter M2STPC and the pulse counter M2PLC compare equal is determined. If the counters M2STPC and M2PLC do not compare equal, the program returns to the main routine; if they compare equal, the feed motor, transport motor and discharge motor are turned off, the CF job counter CFJOBC and CF document feed mode flag CFFMDF are cleared, and then the program returns.

Figure 13:
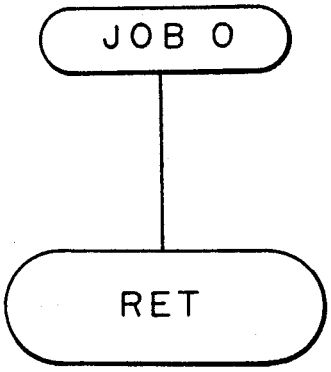
FIGS. 13 through 16 are flowcharts demonstrating respectively jobs JOB0 through JOB3 included in the routine of FIG. 12.
Figure 14:
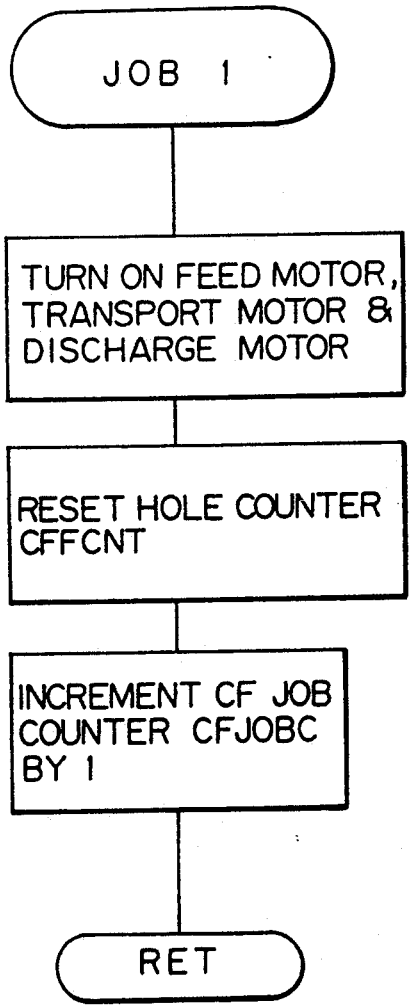

After the CF job counter CFJOBC has been reset in the routine shown in FIG. 15 or 16, the JOB0 shown in FIG. 13 is executed by the routine of FIG. 12. On completing the CF document transport suroutine, the program returns to the main routine.

Figure 17A:
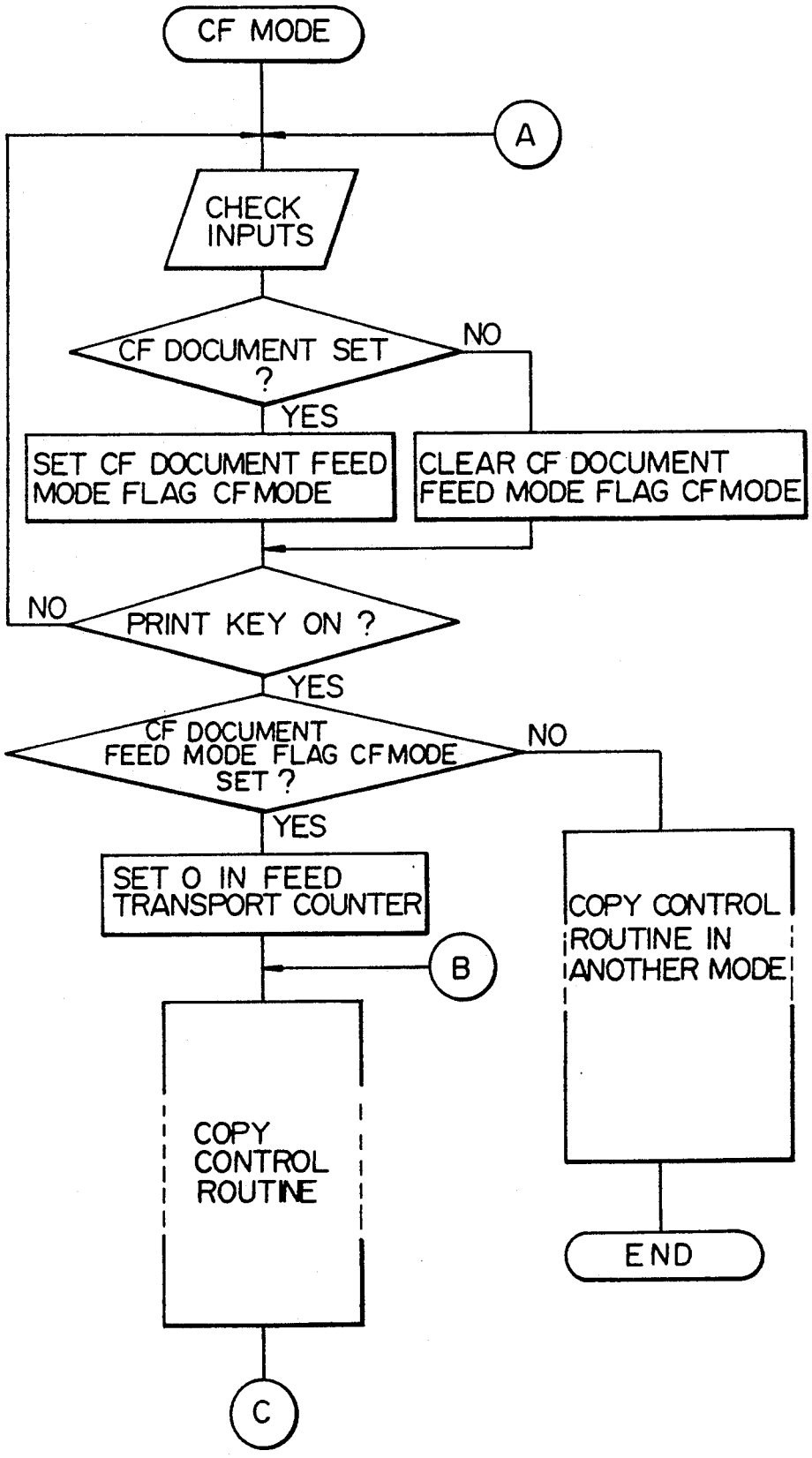
FIGS. 17A and 17B are flowcharts indicative of specific operations relating to the control which a copier controller executes over the transport of a CF document.
Figure 17B:
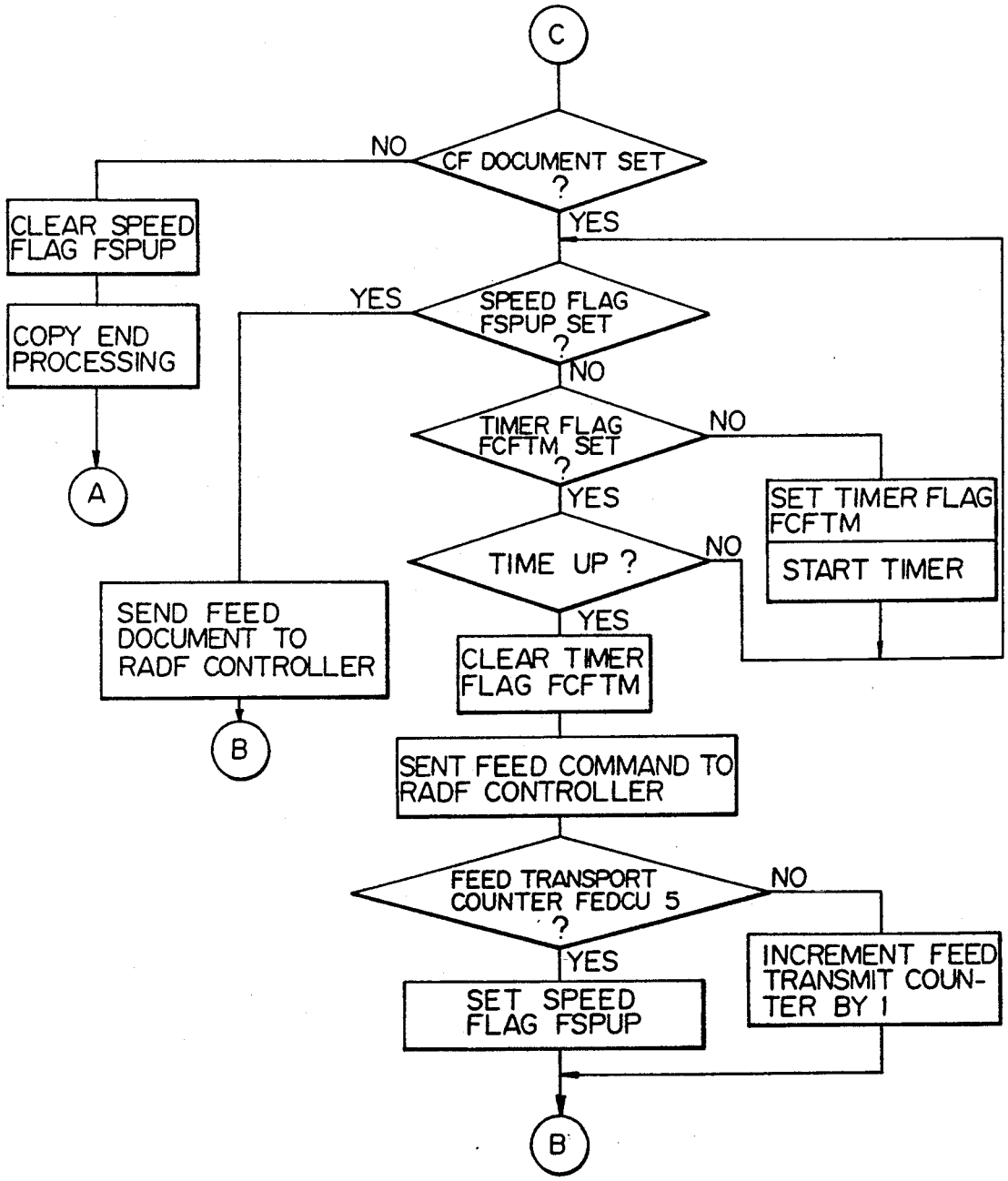

FIGS. 17A and 17B show a specific CF document transport control procedure to be executed by the copier controller 23. In this procedure, it is assumed that the first to fifth pages of the CF paper 6 are reproduced at a speed of 20 c.p.m while the sixth and successive pages are reproduced at a speed of 50 c.p.m. As shown, the copier controller 23 checks various inputs thereto and then determines whether or not CF paper has been set (CF sensor 14 is in an ON state) by referencing a command from the RADF controller 20. If CF paper has been set, the controller 23 sets the CF paper feed mode flag CFMODF; if otherwise, it clears the flag CFMODF, determines whether or not the print key on the operation board 24 has been pressed (ON), and, if not, checks the inputs again. When the print key is pressed, the controller 23 checks the CF paper feed mode flag CFMODF to see if it set and, if it is not set, executes copy control routine in another mode and then completes the entire processing. However, if the CF paper feed mode flag CFMODF is set, the controller 23 sets "0" in a feed transmit counter built therein, executes the copy control routine (corresponding to on page of CF paper), and again determines whether or not CF paper has been set.

If no CF paper has been set, the controller 23 clears a speed flag FSPUP, executes copy end processing, and then returns to the first step. If CF paper has been set, the controller 23 determines whether or not the speed flag FSPUP is set. If the flag FSPUP is set, the controller 23 sends a feed command to the RADF controller 20 immediately and then returns to the copy control routine. If the flag FSPUP is not set, the controller 23 sets it, starts a timer built therein, and again determines whether or not the speed flag FSPUP is set. After setting the timer flag FCFTM, the controller 23 determines whether or not the time is up and, if the answer is negative, returns to the step of determining whether or not the speed flag FSPUP is set. The controller 23 awaits the elapse of the time while repeating the above sequence of steps.

A time associated with the difference between the copying speeds of 20 c.p.m and 50 c.p.m, i.e., 30 c.p.m is set in a ROM which is incorporated in the copier controller 23, so that the copying speed may be switched from 50 c.p.m to 20 c.p.m. The time so set in the ROM is the interval between the start and the end of the above-stated timer. When such a timer expires, the controller 23 clears the timer flag FCFTM, sends a feed command to the RADF controller 20, and then determines whether or not the feed transmit counter FEDCU has reached "5". If the counter FEDCU has not reached "5", the controller 23 increments it by 1; if it has reached "5", the controller 23 sets the speed flag FSPUP and then returns to the copy control routine.

As stated above, the illustrative embodiment selects either one of two different document transport modes, i.e., transports initial fives pages of CF paper at a speed per page which is lower than an ordinary speed. While the lower transport speed is selected, the operator has a sufficient time to determine in which direction the CF paper is easier to fold along the perforation intervening between the first and second pages. Then, the first page will be folded in the correct direction and then set in the box 11.

If desired, the CF paper transport speed may be switched over such that CF paper is transported at an ordinary speed on the start of a printing copying operation and then at a lower speed while several pages of the CF paper are transported after the arrival of the leading edge of the CF paper at the box 11.

In summary, it will be seen that the present invention provides an ADF which gives the operator a sufficient time to determine a direction in which a document in the form of CF paper should be folded along the perforation intervening between the first and second pages. The ADF, therefore, prevents CF paper from being folded in the wrong direction or folded only loosely to overflow a collecting box.

Various modifications will become possible for those skilled in the art after receiving the teachings of the present disclosure without departing from the scope thereof.

What is claimed is:

1. An automatic document feeder (ADF) for use with an image recorder for recording not only ordinary documents in the form of sheets but also continuous computer form (CF) documents having a plurality of pages which are folded along perforations, said ADF comprising:

a) document transporting means for transporting any one of the documents to a predetermined recording position of said image recorder, for setting said document at said predetermined recording position, and, after a recording operation, for transporting and discharging said document into collecting means; and b) control means, operable in a plurality of transport modes, for controlling said document transporting means such that any one of a plurality of the transport modes is selectively set up while CF documents are transported when a particular speed per page is selected, wherein:

1) said plurality of transport modes include:

i) a first document transport mode for transporting the documents at an ordinary speed, and ii) a second document transport mode for transporting said documents at a speed lower than said ordinary speed; and 2) said control means includes:

i) means for controlling said document transporting means such that the CF document is transported in said second document transport mode over a predetermined number of pages after a leading edge of a first page has reached said collecting means.

2. An automatic document feeder (ADF) for use with an image recorder for recording not only ordinary documents in the form of sheets but also continuous computer form (CF) documents having a plurality of pages which are folded along perforations, said ADF comprising:

a) document transporting means for transporting any one of the documents to a predetermined recording position of said image recorder, for setting said document at said predetermined recording position, and, after a recording operation, for transporting and discharging said document into collecting means; and b) control means, operable in a plurality of transport modes, for controlling said document transporting means such that any one of a plurality of the transport modes is selectively set up while CF documents are transported when a particular speed per page is selected;

wherein said plurality of transport modes include:

1) a first document transport mode for transporting the documents at an ordinary speed, and 2) a second document transport mode for transporting said documents at a speed lower than said ordinary speed;

wherein said control means includes means for controlling said document transporting means such that the CF document is transported in said second document transport mode over a predetermined number of pages after a leading edge of a first page has reached said collecting means; and wherein said control means includes means for controlling said document transporting means such that the CF document is transported in said first document transport mode until the leading edge of the first page reaches said collecting means.

* * * * *